United States Patent [19]

Cassel

[11] 4,125,840

[45] Nov. 14, 1978

[54] BROAD BAND DIPOLE ANTENNA

[75] Inventor: Knut E. Cassel, Järfälla, Sweden

[73] Assignee: U.S. Philips Corporation, New York, N.Y.

[21] Appl. No.: 751,445

[22] Filed: Dec. 16, 1976

[30] Foreign Application Priority Data

Dec. 18, 1976 [SE] Sweden ..... 7514395

[51] Int. Cl.[2] ..... H01Q 9/28; H01Q 1/00; H01Q 1/26; H01Q 9/30

[52] U.S. Cl. ..... 343/807; 343/722; 343/826; 343/831; 343/701

[58] Field of Search ..... 343/722, 807, 823, 826, 343/831, 701

[56] References Cited

U.S. PATENT DOCUMENTS

| | | | |
|---|---|---|---|
| 2,267,889 | 12/1941 | Aubert | 343/826 |
| 2,282,292 | 5/1942 | Amy et al. | 343/722 |
| 2,578,973 | 12/1951 | Hills | 343/701 |

OTHER PUBLICATIONS

*The A.R.R.L. Antenna Book*, Newington, Conn., The American Radio Relay League, Inc., 1970, pp. 192–195.

*Primary Examiner*—Alfred E. Smith
*Assistant Examiner*—Harry E. Barlow
*Attorney, Agent, or Firm*—Frank R. Trifari; Algy Tamoshunas

[57] ABSTRACT

A dipole antenna consisting of a number of sub-elements, each sub-element comprising a plurality of thin electric conductors or strips of wires arranged on the surface of an insulating cylinder. The conductors in each sub-element have the same length and are distributed around the circumference of the cylinder, so that each such sub-element forms a so-called "thick" dipole element. The lengths of the conductors in different sub-elements are different, so that the sub-elements together will cover a broad frequency band. At least each conductor in the group having the longest conductors are provided with inductive reactances, to prevent excitation of said longer conductors in higher modes at resonance frequencies of the shorter conductors.

12 Claims, 5 Drawing Figures

BROAD BAND DIPOLE ANTENNA

Figure 2:
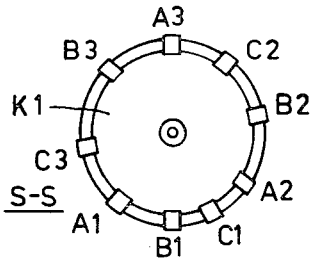

The invention relates to a broad band dipole antenna, comprising at least one dipole half or dipole element, which is composed by a number of sub-elements of different electric lengths, which are arranged in a ring on a cylindrical or conical envelope surface and mutually interconnected at one end, where electric feeding of the elements takes place.

In a known dipole antenna of this kind each sub-element consists of a thin electric conductor and all conductors are of different lengths, a great number of such elements being arranged on a cylindrical envelope surface.

A drawback for this arrangement is that each such "thin" dipole element only operates within a very small frequency band. Thus, if the difference between the length of the different elements is great the antenna as a whole can only operate on certain frequencies, for which the different elements are tuned, but not for intermediate frequencies. It will then also be difficult to prevent that some elements will oscillate in higher modes, which disturbs the radiation from the element operating in the desired mode. If in the contrary the difference between the length of the different elements is made so small that the elements together cover a continuous frequency band, i.e., such that the frequency band for one element is adjacent to or overlapping the frequency band for the next element, this antenna will as a whole in spite of a large number of elements only cover a relatively limited frequency band, or include resonances of higher modes.

It is also known that the band width of a dipole element or a sub-element can be increased thereby that the thickness or the diameter of the used electrical conductors is increased. The parameter, which determines the band width, is more closely the "slimness" of the element, i.e., the ratio between length and thickness.

It is possible in order to save material to make the elements of a number of thin electric conductors, which are combined in a "cage"-like construction. If for example a number of closely arranged, parallel connected electrical conductors of mutually equal lengths are arranged as generatrices in a cylinder or a cone a dipole element of this construction will have the same band width as the dipole made of an integral conductive cylinder or cone of the same size. If the distance between the conductors is made greater so that only a few conductors are arranged along the circumference this will result in that the band width will decrease somewhat but it will still be high as compared with the band width for a corresponding "thin" dipole.

In a known construction of this kind each dipole half consists of a number of such "cages," which are arranged end to end in a row and electrically connected in series with each other by means of coupling capacitances acting between conductor ends in one cage and opposite conductor ends in the adjacent cage. The conductors in each cage are galvanically interconnected by means of conductive supporting rings at each end of the respective cage. The metallic cages form together a "thick dipole" and the effect of the said coupling capacitances between the different sections of this dipole is that the electrical length of the dipole will vary slightly with the frequency.

A drawback for this known dipole, is that the radiation lobe or radiation diagram will be frequency-dependent, more closely the lobe will be smaller (flattened) for higher frequencies due to an aperture size increasing with the frequency, furthermore the obtainable band width is very limited.

The object of the invention is to produce a broad band dipole antenna covering a frequency band of one octave or more and having substantially constant radiation diagram within this entire range, which radiation diagram has the same character as the radiation diagram for a tuned half-wave dipole (half-wave dipole character) and having substantially constant impedance across the whole frequency band.

According to the invention this has been achieved thereby in that each sub-element is formed by a number, preferably at least three, thin electric conductors forming a group with substantially the same physical length on the conductors within a group and different lengths on the conductors in different groups, which conductors in the different groups are distributed along said surface and interlaced in each other, so that each group of conductors will form a so-called "thick" sub-element, and that at least in the group having the longest conductors a reactance having low-pass character, as an inductive reactance, a low-pass filter or a band suppression filter, is arranged in series with each conductor in said group (groups), which reactances show a high impedance for high frequencies in order to prevent excitation of the group (groups) containing said longer conductors in higher modes at high frequencies.

Due to the fact that the thin electrical conductors within the different groups, i.e., sub-elements, are situated on a circular surface with the conductors in the different groups interfoiled in each other a number of parallel-connected "thick" sub-elements are obtained, which all have an essential band width related to the diameter of the said surface. If the lengths of the electrical conductors are so adapted that the frequency bands for the different groups or sub-elements lie adjacent to each other a maximal continuous resulting frequency band for the whole dipole antenna is obtained, which is substantially equal to the sum of the band widths for the sub-elements.

The effect of the said reactances at least in the group containing the longest conductors is to make the outermost portions of the said conductors inoperative for high frequencies, whereby excitation of these long conductors in their full length for high frequencies is prevented, but for low frequencies the said reactances show a low impedance and the conductors are effective in their full length for these frequencies.

If such reactances are arranged in all groups except the group containing the shortest conductors for preventing any group from being excited in a different mode than half-wave mode it is ensured that the radiation lobe or radiation diagram will be constant over the whole frequency band. The fact that for each frequency the antenna acts as an ideal half-wave dipole having the character of a so-called "thick" dipole furthermore ensures that the antenna impedance will show small variations over the whole frequency band. Thus, a broad band of an octave or more has been combined with a constant radiation diagram corresponding to the radiation diagram for an ideal half-wave dipole and a substantially constant impedance over the whole frequency band.

The said reactances can suitably be shaped as the input impedance of a choke or resonator extending along the outer portions of said longer conductors, and having its input facing the inner ends of the conductors, where feeding takes place.

For broadening the frequency band, in which the reactances show a high impedance, the said chokes can have several reflection points or areas of distributed reflections within the choke and multiple resonance structures.

The chokes can suitably be formed by conductor parts extending from the outer ends of the said longer conductors, where they are electrically connected to said ends, substantially parallel with the respective conductor and terminating in an open end forming said input to the choke. Both the conductors forming dipole antenna elements and the conductor parts forming the chokes are suitably shaped as metallic foils or metallic layers lying on said cylindrical or conical envelope surface.

According to a further aspect of the invention the said reactances can be combined with compensation series reactances arranged at the feeding ends of the conductors, which compensation reactances are so selected that they substantially compensate for the mutual coupling reactance from the conductors in remaining groups.

The invention is illustrated in the accompanying drawings, in which

Figure 1:
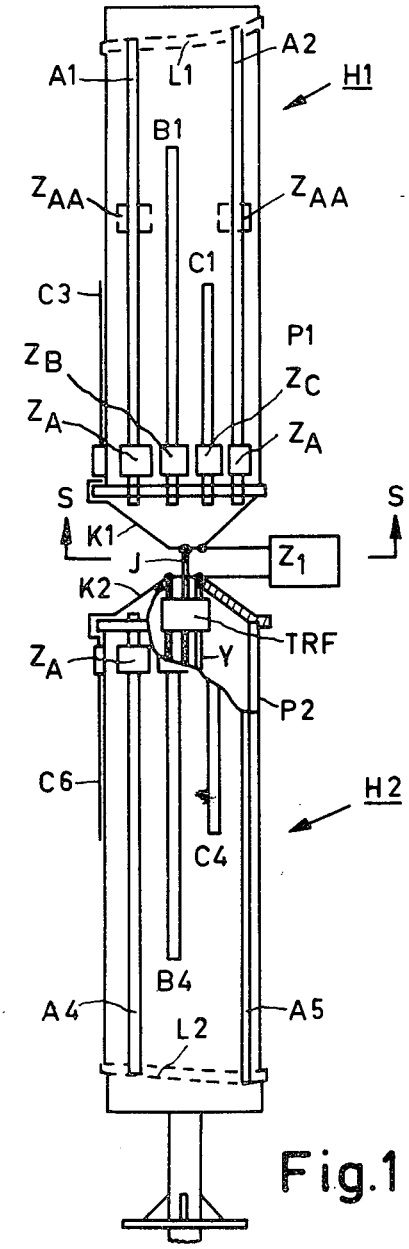
Figure 3:
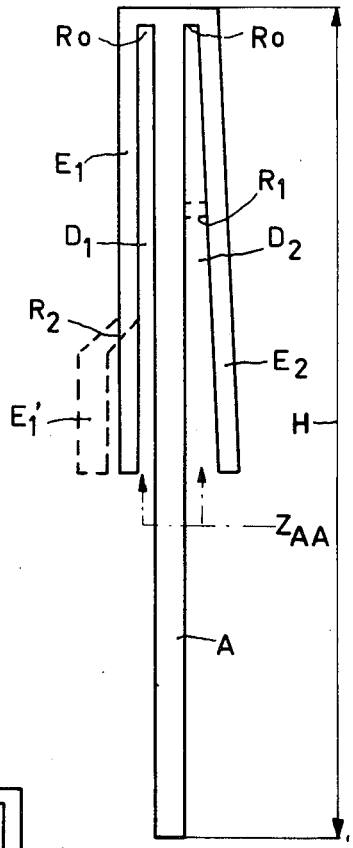
Figure 4:
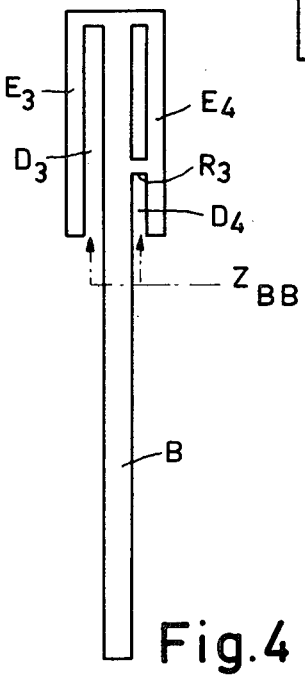
Figure 5:
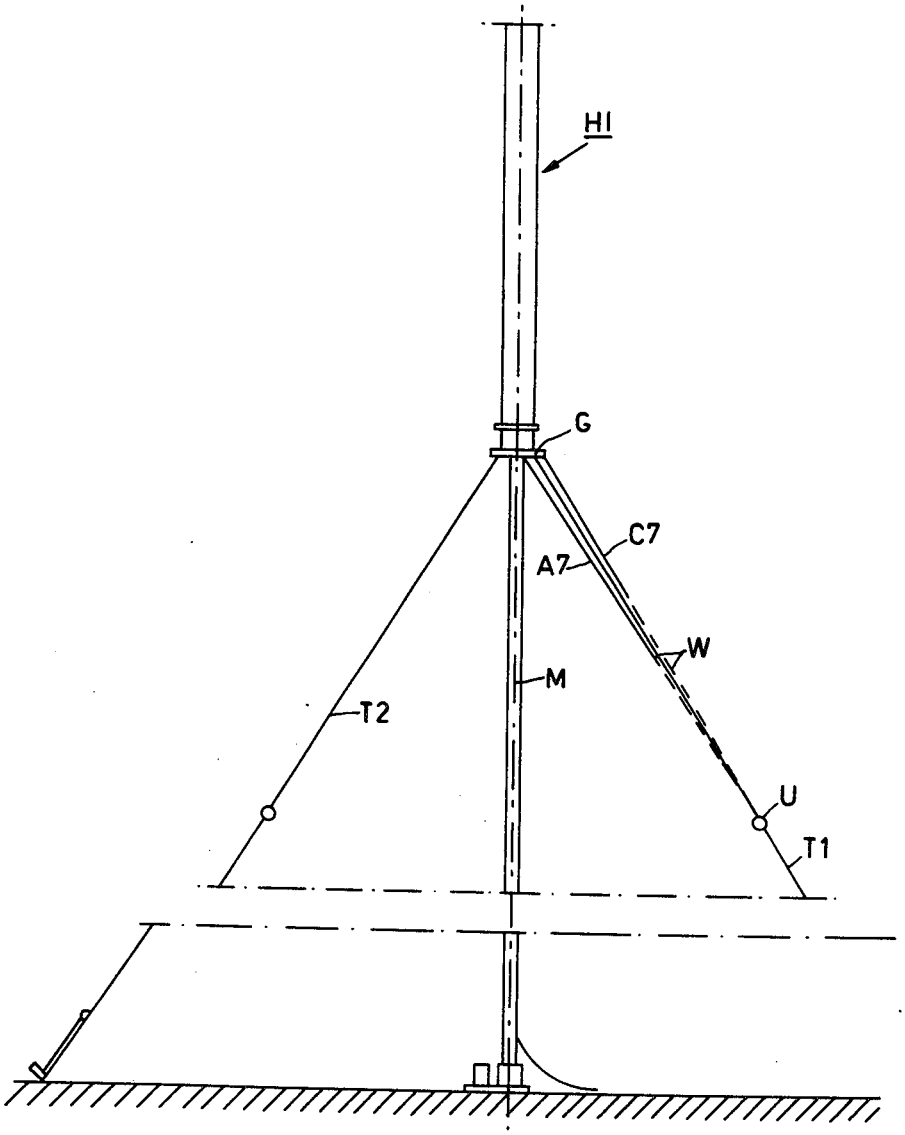

FIG. 1 shows a side view, partly in section, of a dipole antenna according to the invention, FIG. 2 shows an end view as seen along the line S—S in FIG. 1 of the upper diode element in FIG. 1, FIGS. 3 and 4 show schematically two preferred embodiments of dipole element conductors, provided with series reactances for preventing excitation of the respective conductor in a non-desired mode and FIG. 5 shows a dipole antenna according to the invention, in which the lower dipole element is of an alternative construction.

According to the FIGS. 1 and 2 a dipole antenna according to the invention is composed by two substantially equal, co-linearily arranged cylindric dipole elements H1, H2, each consisting of a cylindric plastic tube P1 and P2, which elements at their end surfaces facing each other are terminated by a metallic cone K1, K2. The cone tops facing each other, and suitably as shown somewhat truncated, are galvanically connected to the inner conductor J and the outer conductor Y, respectively, of a supply line constructed as a co-axial cable, which is connected to a radio transmitter or radio receiver. In parallel across the cone tops there is a matching reactance $Z_1$ and in the supply line close to the connection to the metallic cones there is a transformer TRF. By this the characteristic impedance $Z_o$ of the supply line is adapted to the impedance $Z_a$ in the gap between the metallic cones.

According to the invention a number of thin electric conductors, for example in the shape of metallic strips or wires having an arbitrary section, are arranged substantially axially at the outer side of each plastic tube P1, P2 and having one end connected to the base of the respective metallic cone K1, K2. In the shown example each plastic tube has in total nine electric conductors, which are divided into three groups with substantially equal lengths on the conductors in each group but different lengths on the conductors in different groups. The first group of electric conductors having the greatest length comprises the conductors A1, A2, A3 (the upper antenna element) and A4, A5, A6 (the lower antenna element) the next group comprises the electric conductors B1, B2, B3 and B4, B5, B6, respectively, while the last group, in which the conductors have the smallest length, comprises the conductors C1, C2, C3 and C4, C5 and C6, respectively. Close to the place of connection to the base edge of the respective metallic cone K1, K2, there is arranged in each electric conductor an individual series reactance, which is designated with $Z_A$ for the longest conductors A1–A6, with $Z_B$ for the conductors B1–B6 and $Z_C$ for the shortest conductors C1–C6. The reactances $Z_A$, $Z_B$, $Z_C$ can in the simplest case for example be shaped as a small series loop (inductance), a small series capacitance or possibly in some of the groups be equal to zero. The longest elements A1–A6 may possibly, as shown with dotted lines in the drawing be galvanically interconnected through a metallic strip L1 and L2, respectively, at their outer free ends.

According to FIG. 2 the thin electric conductors are so arranged along the periphery of the plastic tube that the conductors within each group are situated with substantially even distribution along the circumference, i.e., with approximately 120° mutual angular distance, and the conductors in the different groups are interfoiled in each other, so that always two conductors belonging to two other groups are situated between two conductors in one and the same group. With start for example with the conductor A1 in the first group (the longest conductors) and travelling in counter-clockwise direction along the circumference, thus, a conductor B1 in the second group will follow and thereafter a conductor C1 in the third group. Thereafter again a conductor A2 from the first group will be reached and the whole is repeated. The same is valid for the second dipole half or dipole element H2.

The three conductors A1–A3, B1–B3, C1–C3, A4–A6, B4–B6, C4–C6 in each group form together a sub-element and due to the fact that the electric conductors A1–A6, B1–B6, C1–C6 in each group are distributed in the space this sub-element forms a so-called "thick" dipole. The "thickness" of the dipole or rather the "slimness," i.e., the ratio between the length and thickness, will determine the band width of the dipole element, which band width will increase with decreasing slimness (or increasing thickness). It can be proved that a dipole element consisting of three narrow electric conductors, which as shown are evenly distributed along the circumference of a circle, will have a band width which corresponds to the band width which should be obtained with a dipole element shaped as a whole conductive cylinder, the diameter of which is approximately 75% of the diameter of the said circle. The "equivalent thickness" for all the sub-elements is thus in the given example approximately 75% of the diameter D of the plastic tube, on which the conductors are arranged (this is valid if each sub-element were alone).

In the shown arrangement according to the invention comprising interlaced conductors associated with different groups or sub-elements, however, the electric conductors belonging to remaining sub-elements will give rise to coupling reactances in a certain dipole, which coupling reactances will tend to decrease the band width in the dipole of concern as compared with the band width this should have had if it had been alone. In order to eliminate this effect the said series reactances $Z_A$, $Z_B$ and $Z_C$ are connected into each electric conductor, which series reactances are so composed and dimensioned that they as far as possible compensate the said coupling reactances. Thus, if a coupling reactance from remaining electric conductors in a sub-element is an inductive impedance of a certain value, a capacitive impedance of the same value is connected into the conductors in the sub-element of concern. If the coupling reactance from remaining sub-elements in a sub-element is a capacitive impedance, an inductive impedance is instead connected into the conductors. In an example $Z_A = 0$ and $Z_B$ and $Z_C$ is an inductive and a capacitive impedance, respectively. Alternatively the reactances may be more complicated and have a more complex frequency characteristic.

With correct dimensioning of the individual reactances $Z_A$, $Z_B$, $Z_C$ each sub-element will have an optimal band width. The length of the different sub-elements will determine the center frequency for the respective element and these lengths are for example selected such in relation to the respective band widths of the sub-elements that the different frequency bands lie close to each other, whereby the whole dipole antenna will have a band width, which corresponds to the sum of the band widths of the sub-elements.

As the bandwidth of the antenna essentially exceeds one octave the current flow at the outermost parts of the longest conductors can be in counter phase relative to the current in remaining parts of the dipole element at the highest frequency domain within the antenna frequency band. One can also express it so that the longest conductors at the highest frequencies within the band can be brought to oscillate for example in a 3/2 λ-mode.

According to the invention this is prevented thereby that reactances, designated $Z_{AA}$ in FIG. 1, have been connected in series with each conductor A1–A6 in the group containing the longest conductors approximately at the middle of the respective conductor. The reactances $Z_{AA}$ have low-pass character and can be formed as an inductive reactance, a low-pass filter or a band suppresion filter. The reactances $Z_{AA}$ form a high impedance for the highest frequencies within the antenna frequency band, at which frequencies the shortest conductors are adapted to operate according to a $\frac{1}{2}$ λ-mode. Thereby the longest conductors A1–A6, are being prevented from effective in their full length at these high frequencies, whereby in first hand excitation of the longest conductors in 3/2 λ-mode is prevented for the highest frequencies. The location and dimensioning of the reactances $Z_{AA}$ can furthermore be such that excitation of the longest conductors in a λ-mode is also prevented at these high frequencies. The reactances $Z_{AA}$ can furthermore be such that they still have a high impedance value for medium frequencies within the antenna frequency band, for which the antenna dipole elements of medium length B1–B6 operate in a λ/2-mode. Hereby excitation of the longest conductors is also prevented at these medium frequencies. Not until the frequency is so low that the conductors of medium length are too short for excitation in λ/2-mode will the impedance value of $Z_{AA}$ have decreased to such a low value that the longest conductors are effective in their full length and carry a half-wave of this low frequency (a quarter wave on each dipole half).

Corresponding reactances can also be arranged in the conductors of medium length B1–B6. These reactances are then so dimensioned that they show a high impedance for the highest frequencies within the antenna frequency band and prevent excitation of the conductors of medium length in a mode other than λ/2-mode.

FIG. 3 shows a preferred embodiment of the conductors A in the longest group with series reactance $Z_{AA}$. This reactance $Z_{AA}$ is in this example constituted by the input impedance of two choke resonators $D_1$ and $D_2$, which resonators are formed between two metallic legs $E_1$, $E_2$ and the conductor A itself. The legs $E_1$, $E_2$ are electrically connected to the conductor A at the outer end of the conductor and extend at a small distance from the conductor A along the outer part of the same. The inner ends of the chokes $D_1$, $D_2$ form reflection points $R_o$ and the impedance characteristic for $Z_{AA}$ versus frequency is, i.a., determined by the distance between these reflection points and the entrance opening. The value of $Z_{AA}$ shall be high both for the highest frequency band and for the medium frequency band. Only for the lowest frequencies in the antenna band $Z_{AA}$ is low. For these low frequencies thus the conductor A is effective in its full length H and a quarter wave is formed along this length H (a half wave for both dipole elements).

In order to broaden the frequency band, within which $Z_{AA}$ shows a high impedance, more reflection points can be arranged within the chokes. An example of this is shown at the right hand arm $E_2$ in FIG. 3, which is arranged oblique relative to the conductor. Hereby a distributed reflection in the choke $E_2$ will be obtained. A reflection point $R_1$ can also be arranged within one of the chokes, which lies closer to the entrance opening than in the second choke, as indicated by dotted lines in FIG. 3. In the left hand part of FIG. 3 it is shown that the leg $E_1$ at its lower end can be provided with a shoulder $R_2$ and after this continue in a part $E_1'$ which extends at a greater distance from the conductor A. The shoulder $R_2$ will in this example form an extra reflection point.

FIG. 4 shows a second embodiment of a dipole element conductor with series reactance, in this case applied to a conductor B of intermediate length. The series reactance, in this example called $Z_{BB}$, is also here constituted by the input impedance of two choke resonators $D_3$, $D_4$ formed by two conductive legs $E_3$, $E_4$. These conductive legs $E_3$, $E_4$ extend from the outer end of the conductor B, where they are electrically connected to the said conductor, in direction to the opposite end of the conductor where feeding takes place. One choke $D_3$, shown to the left in FIG. 4, extends from the entrance opening to the outer end of the conductor. In the second choke a short-circuiting wall $R_3$ forms a reflection point lying closer to the entrance opening and gives a second resonance.

The chokes in FIGS. 3 and 4 form suppression filters consisting of only reactive components, in which these components are provided at space distributed reflection points and in frequency spectrum distributed resonance peaks.

If the reactances $Z_{AA}$ and $Z_{BB}$ are so placed and dimensioned that they prevent excitation of the respective conductor group in any other mode than half-wave mode corresponding to the physical length of the respective conductors, thus, the function of the whole dipole antenna will be that the shortest conductors without reactances will be in operation at the highest frequency domain in the antenna band. For intermediate frequencies within the band the conductors of intermediate length will operate and at the lowest frequency domain the longest conductors will be in operation alone. For all frequencies the antenna acts as an ideal dipole operating in half-wave mode.

FIG. 5 finally shows a dipole antenna according to the invention, where the lower dipole element is shaped in a different manner with conically arranged conductors. The upper dipole element, which is designated with H1 and can be of the same construction as described with reference to the FIGS. 1 and 2, is according to FIG. 5 supported by an antenna mast M and the whole unit is held in upright position by means of three or four wires, of which two T1, T2 are visible in the drawing. The lower dipole element is in this case as in the foregoing example composed of electric conductors of different length, which conductors, however, are not placed outside an insulating tube but are drawn from different points on a conductive flange G at the lower end of the upper dipole element along the respective mast supporting wire to a point U on the wire, where an insulator is situated. Two conductors A7, C7 are as an example shown in the drawing. From the end point of the respective conductor these conductors continue through insulated wires W to the respective point U, where they are fixed to the insulator. In case of for example three wires each of these wires can have three different long conductors, whereby a dipole element having substantially the same characteristic as the previously described element is obtained.

What is claimed is:

1. In a broad band dipole antenna having at least one dipole element adapted to be fed at one end thereof, said dipole element comprising a plurality of groups of sub-elements, the sub-elements of each group having the same electrical length and the sub-elements of different groups having different electrical lengths, the longest sub-elements being electrically connected together at the other end of said dipole element, whereby said antenna has broad band characteristics; the improvement comprising series reactances in the longer of said sub-elements for inhibiting excitation thereof at frequencies higher than those corresponding to its length, said series-reactances being each formed by the input impedance of a resonator extending along portions of said longer sub-elements said resonator having an input facing said one end of said dipole element.

2. The antenna according to claim 1 including a second series reactance in the sub-elements of at least one of said groups for compensating for reactance coupled from sub-elements in the remaining groups.

3. The antenna according to claim 1 wherein the lengths of said sub-elements in such that the frequency bands corresponding to the length of said sub-elements in the different groups are adjacent each other in the frequency spectrum.

4. The antenna according to claim 1 wherein said sub-elements of all groups except the group with the shortest sub-elements have said series reactance.

5. The antenna according to claim 1 wherein said outer surface of said elongated member is conical.

6. The antenna according to claim 1 including an elongated dielectric member, said sub-elements being arranged about the outer surface of said elongated member.

7. The antenna according to claim 6 wherein said sub-elements of different groups are interlaced with one another.

8. The antenna according to claim 6 wherein said outer surface of said elongated member is cylindrical.

9. The antenna according to claim 6 wherein said resonators are each formed by a pair of elongated conductors arranged on said outer surface of said elongated member, each conductor of said pair being disposed adjacent one of two opposite sides of an associated longer sub-element with at least a portion of each conductor extending generally parallel to a portion of said associated longer sub-element, the ends of said conductors adjacent said one end of said dipole element being connected to said associated longer sub-element while the opposite ends of said conductors are spaced from said associated longer sub-element and form said input to said resonator.

10. The antenna according to claim 9 wherein at least one of said conductors of said pair has at least two portions spaced at different distances from said associated longer sub-element to thereby form a resonator having a relatively high reactance over a relatively broad frequency band.

11. The antenna according to claim 10 wherein said at least two portions of said one conductor are connected by a shoulder portion extending generally transversely of said associated longer sub-element.

12. The antenna according to claim 10 wherein said conductors and said sub-elements are formed by thin metal foils.

* * * * *